US006041768A

United States Patent [19]

Giammona et al.

[11] Patent Number: 6,041,768

[45] Date of Patent: Mar. 28, 2000

[54] OVEN HAVING AN ELECTRIC TIMING SYSTEM FOR SAVING AND CONTROLLING GAS

[76] Inventors: John Giammona, 202 Bay 46th St., Brooklyn, N.Y. 11214; Frank Lopa, 94 Grayson St., Staten Island, N.Y. 10306

[21] Appl. No.: 09/267,134

[22] Filed: Mar. 10, 1999

[51] Int. Cl.[7] ..... F24C 3/00

[52] U.S. Cl. ..... 126/39 J; 126/39 R; 126/39 BA; 126/39 G; 126/21 R; 126/21 A

[58] Field of Search ..... 126/39 J, 39 R, 126/42, 39 BA, 39 G, 21 R, 21 A

[56] References Cited

U.S. PATENT DOCUMENTS

| | | | |
|---|---|---|---|
| 1,956,514 | 4/1934 | Olson . | |
| 2,413,237 | 12/1946 | Jones . | |
| 2,489,611 | 11/1949 | Becvar . | |
| 2,691,705 | 10/1954 | Ray . | |
| 4,503,502 | 3/1985 | Chapin | 364/400 |
| 4,718,448 | 1/1988 | Love et al. | 137/171 |
| 4,817,582 | 4/1989 | Oslin et al. | 126/21 A |
| 4,911,068 | 3/1990 | Koether et al. | 99/325 |
| 4,974,624 | 12/1990 | Gotanda | 137/78.4 |
| 5,033,449 | 7/1991 | Hanagan | 126/39 BA |
| 5,400,766 | 3/1995 | Dillon | 126/42 |
| 5,464,953 | 11/1995 | Kim | 200/33 R |
| 5,505,122 | 4/1996 | Gerrit | 99/476 |
| 5,628,242 | 5/1997 | Higley | 99/332 |
| 5,694,916 | 12/1997 | Gambill et al. | 126/42 |

FOREIGN PATENT DOCUMENTS

| | | |
|---|---|---|
| 221466 | 5/1959 | Australia . |
| 516876 | 9/1955 | Canada . |
| 2007435 | 5/1979 | United Kingdom . |

*Primary Examiner*—Larry Jones
*Attorney, Agent, or Firm*—Richard L. Miller, P.E.

[57] ABSTRACT

An improved oven of a type having an on/off pilot and gas valve for receiving gas, with the on/off pilot and gas valve being purely mechanical and having inner workings and a manually operated push button knob, a pilot in communication with the on/off pilot and gas valve and the oven for igniting the oven, a manually operated shut-off valve in fluid communication with the on/off pilot and gas valve for shutting off the gas, and a thermostat in fluid communication with the pilot and in fluid and mechanical communication with the oven for controlling the temperature of the oven. The improvements include an electrical clock timer in electrical communication with the on/off pilot and gas valve for automatically turning on and off the gas output to the oven burner of the on/off pilot and gas valve at a preselected time so as not to allow gas to flow to the oven burner when the oven is not in use and waste the gas, with the preselected time being sufficient to have the oven pre-heated to operating temperature by the time the oven is first used, the on/off pilot and gas valve being electromechanical for electrical and mechanical activation, and the electrical clock timer not being mechanically connected to the manually operated push button knob of the on/off pilot and gas valve, but rather being in electrical communication with the inner workings of the on/off pilot and gas valve, which reduces exposed components and thereby eliminates mechanical failure thereof.

2 Claims, 2 Drawing Sheets

OVEN HAVING AN ELECTRIC TIMING SYSTEM FOR SAVING AND CONTROLLING GAS

BACKGROUND OF THE INVENTION

1. Field of the Invention

The present invention relates to an oven. More particularly, the present invention relates to an improved electric timing system for saving and controlling gas for ovens.

2. Description of the Prior Art

As shown in FIG. 1, a prior art pizza oven 10 has an on/off pilot and gas valve 12 for receiving gas 14, with the on/off pilot and gas valve 12 being purely mechanical and having inner workings 15 and a manually operated push button knob 17, a pilot 16 in communication with the on/off pilot and gas valve 12 and the pizza oven 10 for igniting the pizza oven 10, a manually operated shut-off valve 18 in fluid communication with the on/off pilot and gas valve 12 for shutting off the gas 14, and a thermostat 19 in fluid communication with the pilot 16, which would shut off the on/off pilot and gas valve 12 then stopping the gas 14, and which is in fluid and mechanical communication with the pizza oven 10 for controlling the temperature of the pizza oven 10.

Numerous innovations for cooking apparatus have been provided in the prior art that will be described. Even though these innovations may be suitable for the specific individual purposes to which they address, however, they differ from the present invention.

A FIRST EXAMPLE, U.S. Pat. No. 4,503,502 to Chapin teaches a method and apparatus by which an operator without Chinese cooking skills or knowledge can cook consistent, superior Chinese stir-fry dishes with higher productivity and with a wider repertoire of recipes than that of the traditional Chinese chef. This invention includes means for entering and storing recipe data in a computer control system, means for selecting a recipes from a displayed menu, and means for cooking the selected recipe automatically by the computer control system including addition of food and liquid ingredients at proper intervals, temperature control throughout the cooking process, stirring of the cooking food, and timing of the cooking process, all according to the recipe selected.

A SECOND EXAMPLE, U.S. Pat. No. 4,718,448 to Love et al. teaches a gas valve for providing two levels of flow capacity to a burner that is adapted to enable easy conversion to the valve from use with one type of gas to use with another type. To this end, a low-flow passageway, which establishes the low-flow capacity, is sized to provide the desired low-flow capacity when the valve is used with one type of gas. An opening axially aligned with the passageway, receives a screw means which simply prevents the escape of gas to the exterior of the valve. When the valve is to be converted to use with another type of gas having a higher BTU content, the pressure regulator and burner orifice screw are changed, and the screw means in the axially aligned opening is replaced with a metering screw means which, in addition to preventing the escape of gas, has a portion which extends into the low-flow passageway so as to reduce the effective opening area of the low-flow passageway.

A THIRD EXAMPLE, U.S. Pat. No. 4,817,582 to Oslin et al. teaches a gas-fired combination steam and dry oven that has an oven cavity that is heated by heat exchange from one or more fire tubes and a boiler that is located outside the oven cavity and is heated by heat exchange from one or more other fire tubes. Both the oven and boiler fire tube heat exchangers employ natural draft gas burners. The combination oven can be operated as a forced-air convection oven, a forced-flow convection oven circulating super heated steam, or a steamer circulating saturated steam. Sensors in the oven supply information to a microprocessor that controls the gas burners to maintain an oven temperature within 5 degrees F. or less. Sensors of the level of water in the boiler assure that the water level stays within predetermined limits. Tray stops keep foods and the trays containing them away from the walls of the oven to permit free circulation of air, saturated steam, or super heated steam. Sensors of water temperature in the boiler and of the circulating mixture of air and water vapor temperature in the oven chamber permit the control of relative humidity when the oven is used to proof dough or hold cooked food at a relatively low temperature. Control of the temperature of water in the boiler is aided by blowdown and replacement if the water temperature becomes too high.

A FOURTH EXAMPLE, U.S. Pat. No. 4,911,068 to Koether et al. teaches cooking apparatus, for example, a pressure fryer having a closed cooking vat, which includes a pressure-control system for terminating pressure introduction into the fryer and for releasing pressure therein slightly before the cooking cycle is complete to deter an operator from opening the cooking vat before pressure is released therefrom.

A FIFTH EXAMPLE, U.S. Pat. No. 5,033,449 to Hanagan teaches an electronic grill control that employs a microprocessor-based circuit which monitors cooking temperature, cooking time, fuel level and the presence or absence of flames The fuel level may be displayed alternately as a percentage or fraction of the full tank capacity or in terms of the burning time remaining in the tank. A dual electrode ignition circuit eliminates noise problems in the microprocessor circuitry by establishing the appropriate sparking voltage between the two electrodes instead of between a single electrode and the casting ground. A fuel presence sensor comprising one of the two electrodes measures resistance or conductance of the ionized gases within the flame to provide the microprocessor with an indication that the flame has failed to ignite or has blown out. All information is displayed on an alphanumeric display with audible alarms provided for certain conditions.

A SIXTH EXAMPLE, U.S. Pat. No. 5,464,953 to Kim teaches a timing apparatus including a timer, a solenoid, a toggle switch, and an adapter plate for mounting to the valve control knob of a pizza oven, the adapter plate being provided with a detent at a given point on the periphery thereof. The knob is spring biased in a rotational direction toward the "on" position on the knob. An electrical timer is provided to energize a solenoid at a preset time duration, with the solenoid rod being physically coupled to a pivotable actuating arm, the free end of which is positioned for engagement with the detent of the knob with the knob in the "off" position, the plate being retained at that position against the force of the coil spring. A toggle switch is in electrical circuit relation with the timer, with the toggle thereof physically positioned in operative relation a member projecting from the actuating arm, such that actuation of the toggle from a first position to the second under force of the projection deenergizes the circuit between the timer and the solenoid.

A SEVENTH EXAMPLE, U.S. Pat. No. 5,505,122 to Gerrit teaches a container for transporting warm foodstuffs with a first closable space (1) for the foodstuffs for transporting, a second closable space (2) in thermal contact with a heat source (5), and means (3) for transporting air from said second space to said first space. Container wherein the first space and the second space are mutually adjacent and are mutually separated by an air-permeable partition (4), and the means for transporting air can comprise a fan (3). The heat source comprises for instance a heat exchanger (5) provided with a supply conduit (6) and a discharge conduit (7) for a heat transporting medium, in particular a radiator (5) accommodated in the second space and/or an electrical heating element or a combustion heater (10), in particular a combustion heater operating on motor fuel.

AN EIGHTH EXAMPLE, U.S. Pat. No. 5,628,242 to Higley teaches an activity monitor for a gas cooker or grill which monitors activity with a motion detector. When the grill has not been used for a preselected time period, the gas supply is automatically shut off to avoid fire hazard and/or wasting of fuel. An adjustable timer is used to activate the automatic shut off of the gas supply only after no motion has been detected for a preselected time period. A default timer value can be used when the grill is initially activated. If motion is detected prior to gas supply shut off, then the timer is reset to zero. Motion detection is accomplished by one or more methods including a lid position sensor to detect when the grill lid is moved between the open and the closed position a motion detector which monitors switch usage to detect activity, and vibration or movement monitors.

A NINTH EXAMPLE, British Patent No. 2,007,435 to Pye teaches a timing device, for turning a cooker (for example) on after a first timed period and off after a second timed period, has a pair of coaxial drum-shaped face cams 15 and 16, manually rotatable to select the two timed periods respectively. Between the cams lies a lever 26 mounted on a spindle 20, the spindle having limited freedom for axial movement to operate a switch 24 which controls the cooker. The spindle and lever are rotatably time driven via gears 22, 21 so that the lever moves over the cam faces of the cams. The two cams are manually settable and cause the lever to rock in turn about each end, carrying with it the spindle, so as to operate the switch at the set times.

A TENTH EXAMPLE, Australian Patent No. 221,466 to Midgley teaches a time controlled mechanism for use with electric or gas cookers or other apparatus for automatically effecting the closing and opening of a switch or gas valve at predetermined times so as to bring about the delayed starting or stopping of a cooking or other operation, wherein the delayed starting and stopping times of a cooking operation are predetermined by a pair of rotatable setting devices which are arranged to bring about the operation of a clockwise mechanism so as to effect the closing and opening of a heating circuit or gas supply at the predetermined delayed starting and stopping times, said clockwork mechanism being driven by an electric motor, the circuit of which is controlled by said setting devices in such a way as to cause said clockwork mechanism to be automatically started into operation by the setting operation and to be automatically stopped at the end of the cooking operation.

AN ELEVENTH EXAMPLE, Canadian Patent No. 516,876 to Midgley teaches a time switch comprising a clockwork mechanism, two moving switch-operating members for performing switch operations, and driven by the clockwork mechanism, the two moving switch-operating members being bodily rotatable together away from their operating positions in a setting operation so that the clockwork mechanism will return to them to their operating positions only after the time interval required for the clockwork mechanism to rotate them back from their displace position to their operating position, and means for displacing one switch-operating member with respect to the other so that in the restoring movement under the control of the clockwork mechanism the one switch will carry out its switch operation before the other switch carries out its switch operation by a period determined by the amount by which the two switch-operating members have been mutually displaced.

It is apparent that numerous innovations for cooking apparatus have been provided in the prior art that are adapted to be used. Furthermore, even though these innovations may be suitable for the specific individual purposes to which they address, however, they would not be suitable for the purposes of the present invention as heretofore described.

SUMMERY OF THE INVENTION

ACCORDINGLY, AN OBJECT of the present invention is to provide an improved oven that avoids the disadvantages of the prior art.

ANOTHER OBJECT of the present invention is to provide an improved oven that is simple and inexpensive to manufacture.

STILL ANOTHER OBJECT of the present invention is to provide an improved oven that is simple to use.

BRIEFLY STATED, YET ANOTHER OBJECT of the present invention is to provide an improved oven of a type having an on/off pilot and gas valve for receiving gas, with the on/off pilot and gas valve being purely mechanical and having inner workings and a manually operated push button knob, a pilot in communication with the on/off pilot and gas valve and the oven for igniting the oven, a manually operated shut-off valve in fluid communication with the on/off pilot and gas valve for shutting off the gas, and a thermostat in fluid communication with the pilot, which would shut off the on/off pilot and gas valve then stopping the gas, and which is in fluid and mechanical communication with the oven for controlling the temperature of the oven. The improvement includes an electrical clock timer in electrical communication with the on/off pilot and gas valve for automatically turning on the on/off pilot and gas valve at a preselected time so as not to leave the on/off pilot and gas valve on when the oven is not in use and waste the gas, with the preselected time being sufficient to have the oven preheated to operating temperature by the time the oven is first used. The improvement further includes the on/off pilot and gas valve being electro-mechanical for electrical and mechanical activation. The improvement further includes the electrical clock timer not being mechanically connected to the manually operated push button knob of the on/off pilot and gas valve, but rather being in electrical communication with the inner workings of the on/off pilot and gas valve, which reduces exposed components and thereby eliminates mechanical failure thereof.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Prior Art

| | |
|---|---|
| 10 | oven |
| 12 | on/off pilot and gas valve for receiving gas 14 |
| 14 | gas |
| 15 | inner workings of on/off pilot and gas valve 12 |
| 16 | pilot for igniting oven 10 |
| 17 | manually operated push button knob of on/off pilot and gas valve 12 |
| 18 | shut-off valve for shutting off gas 14 |
| 19 | thermostat for controlling temperature of oven 10 |

Improvement

| | |
|---|---|
| 20 | improved oven |
| 22 | electrical clock timer for automatically turning on and off on/off pilot and gas valve 12 for flowing gas 14 to thermostat 19 |
| 24 | 24V transformer |

DETAILED DESCRIPTION OF THE PREFERRED EMBODIMENT

Figure 1:
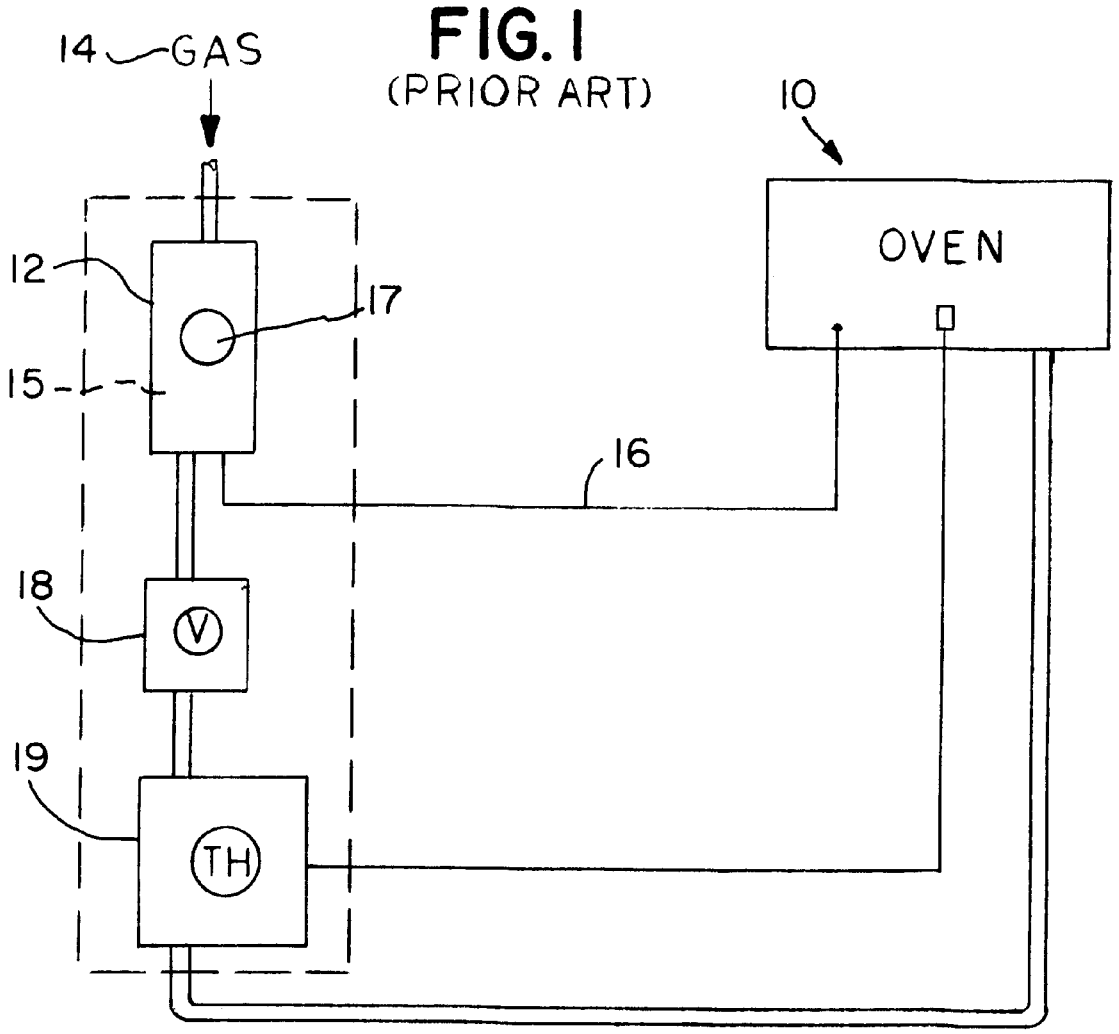
FIG. 1 (PRIOR ART)
FIG. 1 is a block diagram of a prior art oven.
Figure 2:
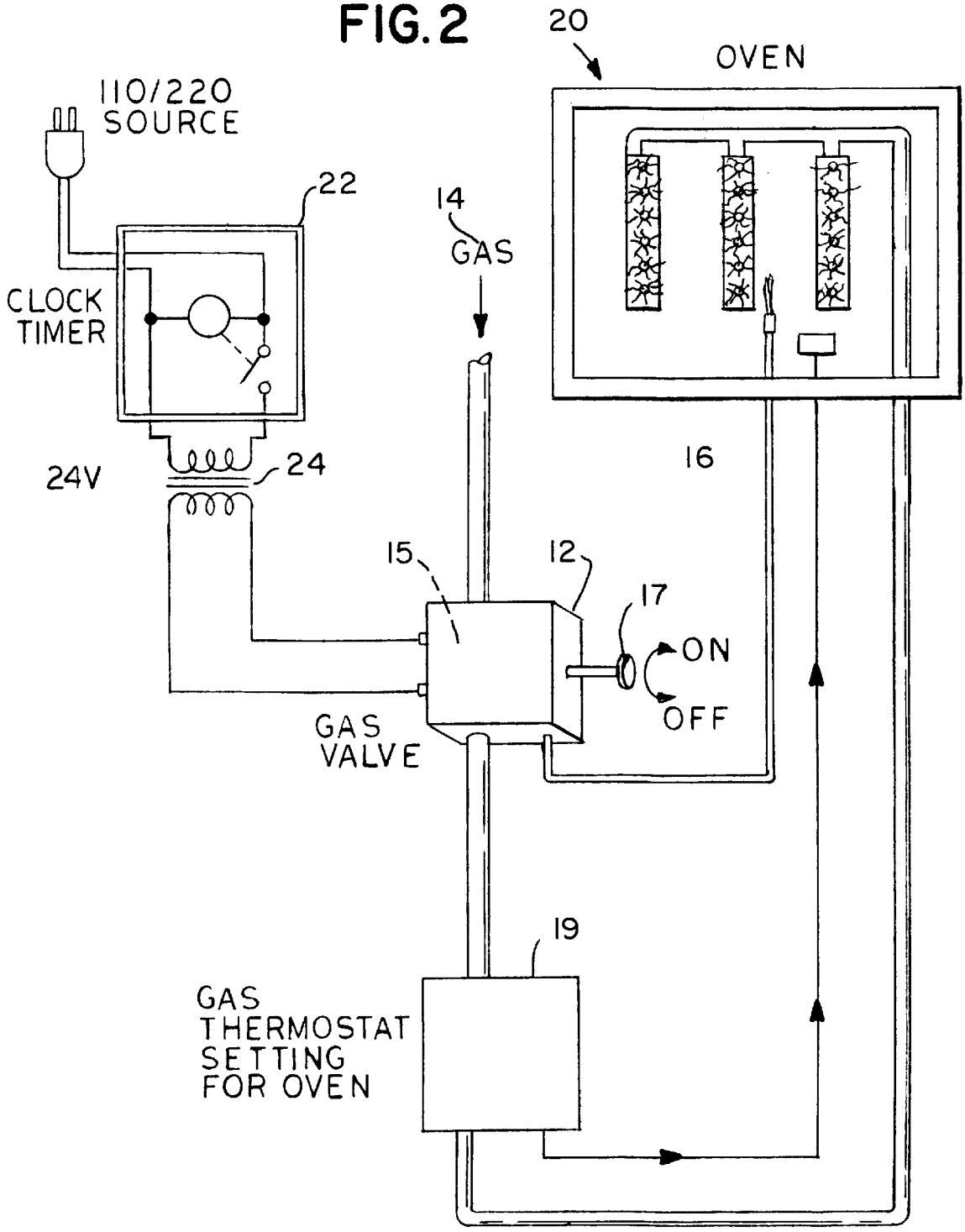
FIG. 2 is a block diagram of the improved oven of the present invention.

Referring now to the figures, in which like numerals indicate like parts, and particularly to FIG. 2, the improved oven of the present invention is shown generally at 20.

The improvement comprises an electrical clock timer 22 in electrical communication with the on/off pilot and gas valve 12 for automatically turning on the on/off the gas output to the oven burner of pilot and gas valve 12 at a preselected time so as not to allow gas to flow to the oven burner, when the oven 20 is not in use and waste the gas 14, with the preselected time being sufficient to have the oven 20 pre-heated to operating temperature by the time the oven 20 is first used.

The improvement further comprises the on/off pilot and gas valve 12 being electromechanical for electrical and mechanical activation.

A typical combination electromechanical on/off pilot and gas valve 12 is of the type sold by WHITE-RODGERS DIVISION, Emerson Electric Co., 9797 Reavis Road, St. Louis, Mo. 63123-5398, under Model Nos. 36C03 and 36C13.

The improvement further comprises the electrical clock timer 22 not being mechanically connected to the manually operated push button knob 17 of the on/off pilot and gas valve 12, but rather being in electrical communication with the inner workings 15 of the on/off pilot and gas valve 12, which reduces exposed components and thereby eliminates mechanical failure thereof.

Even though the electrical clock timer 22 not being mechanically connected to the manually operated push button knob 17 of the on/off pilot and gas valve 12 may be considered a negative limitation by some, it is the only way, and by far the clearest way, to state the limitation, and therefore must be considered in determining patentability. Support for this assertion can be found in the notice entitled "*Practice Re: Technical Rejections,*" dated Apr. 30, 1965 (814 O.G. 715), which states that:

"The inclusion of a negative limitation shall not, in itself, be considered a sufficient basis for objection to or rejection of a claim."[Emphasis added]

And, in In re Duva, 156 USPQ 90, 94 (CCPA 1967), where the Court stated:

". . . it [is] held proper to claim a negative limitation even if a positive expression could have been employed and even at the 'point of novelty'. . . "[Emphasis added]

The fact that the electrical clock timer 22 not being mechanically connected to the manually operated push button knob 17 of the on/off pilot and gas valve 12 is of critical importance and obviously a point of novelty, since it reduces exposed components and thereby eliminates mechanical failure thereof.

The electrical clock timer 22 runs on a 110/220V source, and therefore requires a 24V transformer 24 in electrical communication between the electrical clock timer 22 and the on/off pilot and gas valve 12.

It will be understood that each of the elements described above, or two or more together, may also find a useful application in other types of constructions differing from the types described above.

While the invention has been illustrated and described as embodied in an improved oven, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved oven of a type having an on/off pilot and gas valve, with the on/off pilot and gas valve being purely mechanical and having inner workings and a manually operated push button knob, a pilot in communication with the on/off pilot and gas valve and the oven for igniting the oven, a shut-off valve in fluid communication with the on/off pilot and gas valve for shutting off the gas, and a thermostat in fluid communication with the shut-off valve and in fluid and mechanical communication with the oven for controlling the temperature of the oven, said improvement comprising:

a) an electrical clock timer in electrical communication with the on/off pilot and gas valve for automatically turning on and off the gas output to the oven burner of the on/off pilot and gas valve at a preselected time so as not to allow gas to flow to the oven burner when the oven is not in use and waste the gas, with the preselected time being sufficient to have the oven pre-heated to operating temperature by the time the oven is first used;

b) the on/off pilot and gas valve being electro-mechanical for electrical and mechanical activation; and c) said electrical clock timer not being mechanically connected to the manually operated push button knob of the on/off pilot and gas valve, but rather being in electrical communication with the inner workings of the on/off pilot and gas valve, which reduces exposed components and thereby eliminates mechanical failure thereof.

2. The improved oven as defined in claim 1, wherein said electrical clock timer runs on a 110/220V source, and therefore requires a 24V transformer in electrical communication between said electrical clock timer and the on/off pilot and gas valve.

* * * * *